United States Patent [19]

Tölle

[11] 4,357,039

[45] Nov. 2, 1982

[54] LOCK BOLT FOR MOTOR-VEHICLE DOOR LATCH

[75] Inventor: Karl-Heinz Tölle, Wuppertal-Ronsdorf, Fed. Rep. of Germany

[73] Assignee: Tack & Gabel GmbH & Co. KG, Wuppertal-Ronsdorf, Fed. Rep. of Germany

[21] Appl. No.: 185,885

[22] Filed: Sep. 10, 1980

[30] Foreign Application Priority Data

Sep. 13, 1979 [DE] Fed. Rep. of Germany ..... 2936997

[51] Int. Cl.[3] ..... E05B 15/02

[52] U.S. Cl. ..... 292/341.12; 292/DIG. 56

[58] Field of Search ..... 292/340, 341.12, 341.13, 292/DIG. 39, DIG. 40, DIG. 41, DIG. 56, 216; 70/463

[56] References Cited

U.S. PATENT DOCUMENTS

| | | | |
|---|---|---|---|
| 2,987,336 | 6/1961 | Kramer | 292/341.12 |
| 3,296,694 | 1/1967 | DeMestry | 292/341.12 |
| 3,572,797 | 3/1971 | Shay | 292/341.12 |
| 3,591,225 | 7/1971 | Hagemeyer | 292/341.12 |
| 3,997,202 | 12/1976 | Tack | 292/216 |
| 4,097,078 | 6/1978 | Tack | 292/216 |

FOREIGN PATENT DOCUMENTS 7247283 12/1972 Fed. Rep. of Germany .

*Primary Examiner*—Robert L. Wolfe
*Attorney, Agent, or Firm*—Montague & Ross

[57] ABSTRACT

A motor-vehicle door lock has a lock bolt defining an axis and normally secured to the doorpost. A locking fork normally secured to the door edge can engage this lock bolt to retain the door against the doorpost. The bolt is formed of a rigid axially extending metal core and at least one axially deformable synthetic-resin body on the core. The core has a plurality of annular ridges having outer surfaces and defining a plurality of outwardly open annular grooves and the body fills these grooves and projects radially therefrom beyond the outer surface of the ridges. The ridges and grooves may be separate and annular, or may be the turns of a helical screwthread formation.

10 Claims, 4 Drawing Figures

LOCK BOLT FOR MOTOR-VEHICLE DOOR LATCH

FIELD OF THE INVENTION

The present invention relates to a motor-vehicle door latch. More particularly this invention concerns a lock bolt for such a latch.

BACKGROUND OF THE INVENTION

A motor-vehicle door latch of the type described in commonly owned U.S. Pat. Nos. 3,997,202 and 4,097,078 has a lock bolt defining an axis and normally secured to a doorpost. A locking element normally secured to the door edge is engageable with this lock bolt to retain the door against the doorpost. The locking element is normally formed as a pivotal fork that can be retained in place around the lock bolt by a pivotal lock pawl.

In order to minimize the noise generated by such a latch mechanism it is known from German utility model 7,247,283 to provide an elastic covering for the region of the lock bolt engaged by the locking element or for the portion of the locking element that engages the lock bolt. When mounted on te bolt the elastic covering is normally formed as a sleeve having cylindrical inner and outer surfaces and received in a cylindrical outwardly open groove of the lock bolt.

As a door equipped with such a latch is closed the locking-element fork engages and is turned by the lock bolt. The door moves in the closing direction a certain distance further than its normal rest position, which movement is possible due to the compressibility of the elastomeric door-edge seal. Thus the door rebounds somewhat against the fork whick by this time is locked securely in position by its lock pawl. The noise that would normally be created by this springing back against the locked door fork is greatly damped by the synthetic-resin sleeve on the bolt.

The considerable disadvantage of such a system is that the synthetic-resin covering for the door bolt very quickly wears out. After only a relatively short service life it normally develops a hole in the location most often engaged by the locking fork, and normally becomes so loose as to rotate on the door bolt. Eventually this elastomeric covering is damaged to the point where it either falls off or is completely useless for absorbing sound.

OBJECTS OF THE INVENTION

It is therefore an object of the present invention to provide an improved door bolt for a motor-vehicle door latch of the above-described general type.

Another object is to provide such a door bolt which has a longer service life and greater noise-damping capacity than the known type.

SUMMARY OF THE INVENTION

These objects are attained according to the instant invention by forming the lock bolt of a rigid axially extending metal core having a plurality of annular edges having outer surfaces and defining a plurality of outwardly open annular grooves and at least one elastically deformable synthetic-resin body which fills these grooves and projects radially therefrom beyond the outer surfaces of the ridges.

This use of a plurality of such grooves ensures an extremely good hold for the synthetic-resin body on the metal core and similarly ensures that the synthetic-resin body will be relatively thick so as to have a long service life. Not only can be synthetic-resin body be deformed radially, but also axially and the portion of it in the grooves below the level of the outer surfaces of the ridges can never be badly damaged in use.

According to the instant invention a sleeve having a cylindrical outer surface constitutes the body, the inner surface of the sleeve being complementary to the core between the outer head of the bolt and its threaded inner end or shaft. With such an arrangement the portions of the sleeve deeply embedded in the grooves of the core will never by subjected to wear so that the overall life of the elastic body will be very long. Even if those portions of the sleeve that radially overlie the outer surfaces of the ridges are damaged, the body will continue to absorb sound effectively. In fact, even if the body becomes worn through and frayed at the outer surfaces of the ridges it will continue to cushion and absorb sound virtually as well as when new.

It is possible according to this invention to form the ridges and grooves either separate and annular, or as individual turns of a helical recess and helical screwthread formation. The screwthread formation may have a trapezoidal section so that the outer surfaces lie on an imaginary cylinder parallel to the outer surface of the body. The prior-art devices having a single annular groove filled with a single synthetic-resin body with cylindrical inner and outer surfaces have been found to be deficient in that they can squeeze sometimes past the lock bolt even when the door is supposed to be latched. With the system according to the instant invention with a relatively great diameter at the ridges this type of action is impossible so that the lock is substantially safer than the prior-art locks.

SPECIFIC DESCRIPTION

Figure 1:
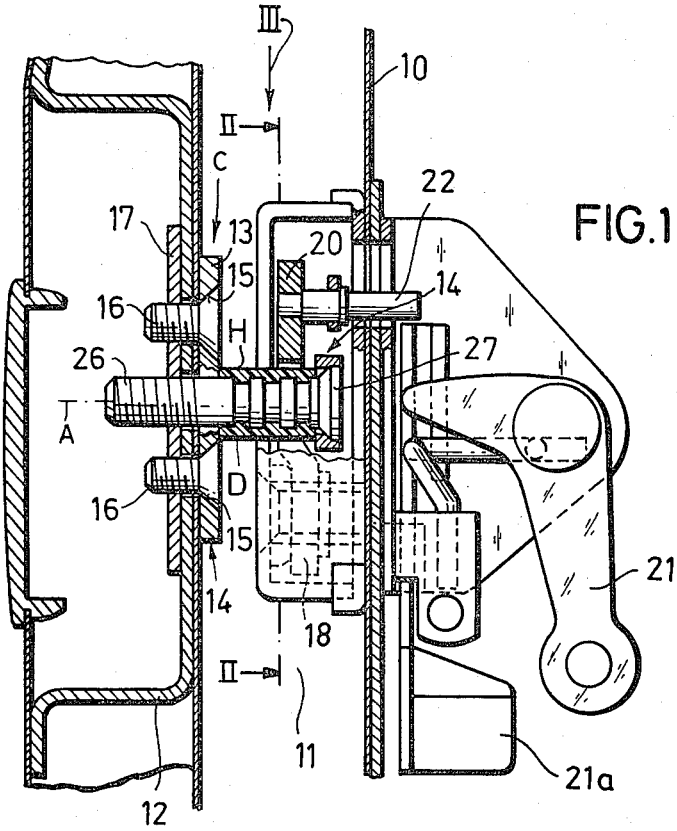
FIG. 1 is a vertical section through the lock according to the instant invention.
Figure 2:
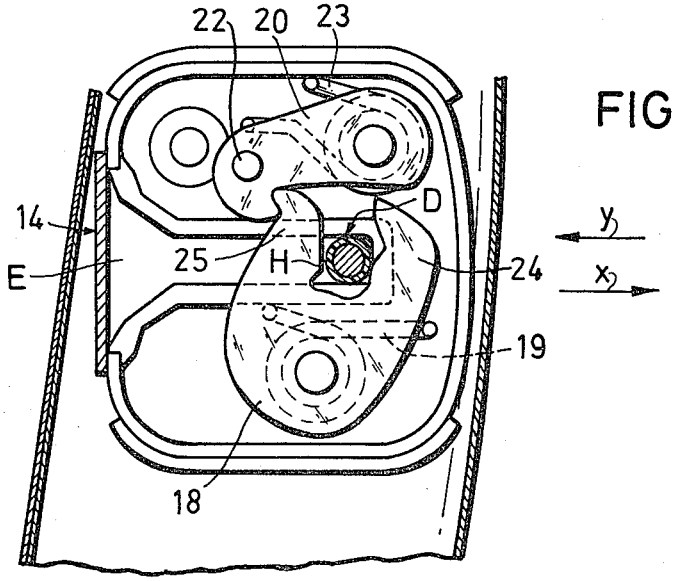
FIG. 2 is a section taken along line II—II of FIG. 1.

As seen in FIGS. 1 and 2, a motor-vehicle door edge 10 is normally separated by a space 11 from a doorpost 12. A lock bolt indicated generally at D passes through a base plate 13 secured to one side of the doorpost 12 and is threaded into an anchor plate 17 secured to the other side of the door edge 12 and secured to the plate 13 by screws 16 seated in holes 15 in this plate 13. The plate 13 is one leg of a U-shaped element best seen in FIG. 4, and having another leg 33.

The latch mechanism comprises a standard locking element 18 constituting a fork having a rear leg 25 and a front leg 24, relative to the closing direction y of the door, which is opposite the opening direction x (FIG. 2). A spring 19 urges this fork 18 counterclockwise, as seen in FIG. 2, so as to normally push the door in the opening direction x. A lock pawl 20 urged into engagement with the fork 18 by a spring 23 has an actuating pin 22 that can be operated either by an actuating lever 21 connected to the outside door handle or an actuating lever **21*a*** connected to the inside door handle.

Figure 3:
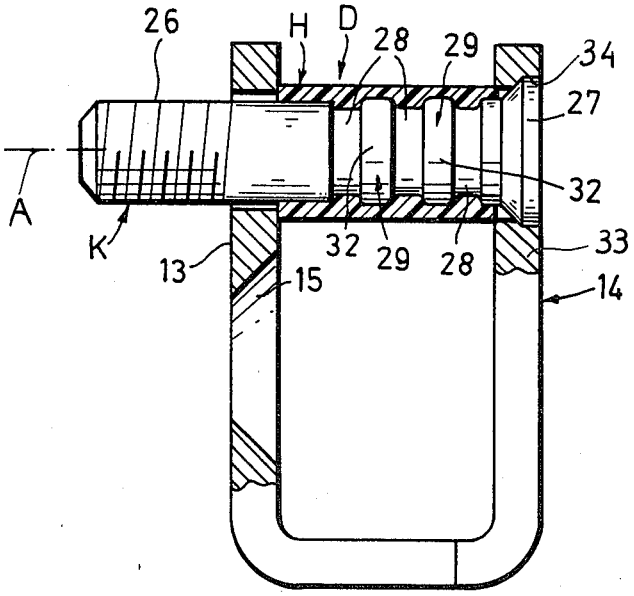
FIG. 3 is a view, partly in section, taken in the direction of arrow III of FIG. 1 through a portion of the assembly of FIG. 1.

As seen in FIG. 3 the door bolt D according to this invention has a solid steel core K surrounded by a polyester sleeve H. The core K has at one end an enlarged head 27 received in a complementary recess 34 of the leg 33 and a threaded inner end 26 between the two legs 13 and 33 of the U-shaped element 14.

The core K is formed with annular ridges 29 having cylindrical outer surfaces 32 and defining annular grooves 28. The outer surface of the sleeve H is cylindrical and centered on the axis A of the bolt and the inner surface is complementary to the grooves 28 and ridges 29, and extends the full distance between the two legs 13 and 33 of the U-shaped element 14.

Figure 4:
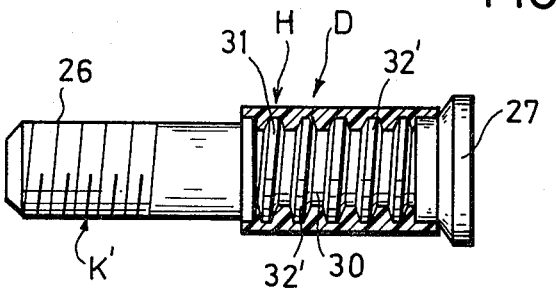
FIG. 4 is a partly sectional side view showing the lock bolt according to this invention.

It is also possible, as shown in FIG. 4, to form a core K′ with a helical ridge or screwthread formation 31 of trapezoidal cross section and having a cylindrical outer surface 32′. A helical recess 30 functionally identical to the grooves 28 is formed by this ridge 31.

As can be seen by comparison of FIGS. 3 and 4 with FIGS. 1 and 2, the synthetic-resin sleeve 11 will rebound against the inner edge of the front leg 25 when the door is slammed. Inspite of the considerable abrasion the sleeve H will be subjected to at this location, however, it will remain well secured to the core K because of the engagement in the grooves 28 and 30. Even over a long service life good noise damping will be ensured, since the sleeve will project at least radially beyond the projections 29 and 31.

I claim:

1. In a motor-vehicle door lock wherein a lock bolt defining an axis and normally secured to the doorpost is engaged by a locking element normally secured to the door edge to retain the door against the doorpost, the improvement wherein said bolt is formed of:

a rigid axially extending metal core having a plurality of annular ridges having outer surfaces and defining a plurality of outwardly open annular grooves, and at least one elastically deformable synthetic-resin body filling said grooves and projecting radially therefrom beyond said outer surfaces of said ridges.

2. The improvement defined in claim 1 wherein said body is a sleeve coaxially surrounding said grooves and said ridges of said core.

3. The improvement defined in claim 2 wherein said outer surfaces lie on an imaginary cylinder centered on said axis.

4. The improvement defined in claim 3 wherein each of said ridges and each of said grooves is circularly annular and separate from the respective other ridges and grooves.

5. The improvement defined in claim 3 wherein said ridges are turns of a continuous generally helical screwthread formation defining a helical recess having turns constituting said grooves.

6. The improvement defined in claim 3 wherein said body completely fills said grooves.

7. The improvement defined in claim 3 wherein said body has an enlarged outer head and a threaded inner end, said sleeve lying between said head and inner end.

8. The improvement defined in claim 7 wherein said lock includes a U-shaped plate secured to said door post and having one leg formed with a recess snugly receiving said head and another leg formed with a throughgoing hold through which said shank passes, said sleeve lying substantially wholly between said legs.

9. The improvement defined in claim 8 wherein said lock includes a pivotal lock fork engageable around said bolt in contact only with said sleeve thereof.

10. The improvement defined in claim 1 wherein said body is of a thermoplastic polyester.

* * * * *